United States Patent [19]

Ailawadhi et al.

[11] 4,135,776

[45] Jan. 23, 1979

[54] SOLDERLESS COAXIAL CABLE CONNECTOR

[75] Inventors: Manohar L. Ailawadhi; James H. Ryan; Chander M. Wahi, all of Waseca, Minn.

[73] Assignee: E. F. Johnson Company, Waseca, Minn.

[21] Appl. No.: 763,367

[22] Filed: Jan. 28, 1977

[51] Int. Cl.[2] ..... H01R 17/04

[52] U.S. Cl. ..... 339/177 R; 339/89 C

[58] Field of Search ..... 339/177 R, 177 E, 89 C

[56] References Cited

U.S. PATENT DOCUMENTS

| | | | |
|---|---|---|---|
| 2,449,983 | 9/1948 | Devol | 339/177 R |
| 2,460,304 | 2/1949 | McGee et al. | 339/177 R |
| 3,206,540 | 9/1965 | Cohen | 339/177 R |
| 3,245,027 | 4/1966 | Ziegler, Jr. | 339/89 C |
| 3,297,979 | 1/1967 | O'Keefe et al. | 339/177 R |
| 4,053,200 | 10/1977 | Pugner | 339/177 R |

FOREIGN PATENT DOCUMENTS

| | | | |
|---|---|---|---|
| 1411067 | 10/1975 | United Kingdom | 339/177 R |

*Primary Examiner*—Neil Abrams

*Attorney, Agent, or Firm*—Warren A. Sturm; Hugh D. Jaeger

[57] ABSTRACT

A solderless coaxial cable connector for securely holding coaxial cable without indentation to the cable dielectric and offering a high strength joint at the connector. A conductive cylindrical body having four annular ratchet teeth keeps the connector from rotating when mated. The small end of the body accomodates a screw sleeve or a crimp sleeve for the outer conductors of the coaxial cable connector. The large end of the body accommodates a tubular insulator with a bore for a crimp type contact for a solid or stranded center conductor of the coaxial cable. A female nut is held in place at the center portion of the body between the large diameter section and the sleeve, either crimp or screw, to act as a coupling nut when the connector is mated.

1 Claim, 2 Drawing Figures

SOLDERLESS COAXIAL CABLE CONNECTOR

BACKGROUND OF THE INVENTION

1. Field of the Invention

This invention relates generally to a connector, and more particularly, pertains to a solderless coaxial cable connector.

2. Description of the Prior Art

In the field of coaxial cable connectors, it has been a general practice to utilize coaxial cable connectors in which the inner and outer conductors of the coaxial cable are soldered to the respective center contact and the body or adapter required for the coaxial connector. Such coaxial connectors are unsatisfactory for two reasons.

First, the soldering of the inner and outer conductors of coaxial cable usually results in the melting of the cable dielectric thus causing a disturbance to the coaxial cable impedance characteristic. The dielectric between the inner and outer conductors of the coaxial cable usually melts taking a new shape with physical indentations such that the cable impedance characteristic is changed at the end nearest the coaxial connector from the normal characteristic impedance of the cable. This is undesirable as a standing wave ratio results on the coaxial cable from the varying cable impedance characteristic caused by the physical indentation of the cable dielectric. Second, soldering usually causes a weakness in the strength of the joint where the inner and outer conductors of the coaxial cable are soldered to the connector as the junctions between the soldered portion of the cable and the cable itself are so abrupt as to break under normal condition of use.

This invention overcomes the disadvantages of the prior art by providing a solderless coaxial cable connector so as not to disturb the cable impedance characteristic and provide sufficient strength to the joint to withstand all the forces to which the coaxial cable connector might be subjected under normal conditions of use.

SUMMARY

The present invention obviates the foregoing disadvantages of prior art by providing a solderless coaxial cable connector in which the coaxial cable is held securely in place in the connector without indentation of the cable dielectric which assures no disturbance to the cable impedance characteristic. Also, the joint afforded between the connector and the coaxial cable is such as to withstand the forces to which the coaxial connector might be subjected to under normal conditions of use.

According to one embodiment of the present invention, there is provided a solderless coaxial cable connector having a body with a center area of one diameter, on one end of a large diameter having equally spaced four annular ratchet teeth diagonally opposite for keeping the connector in place while mated with a female coaxial connector on the other end, a small diameter to accept the outer braid of coaxial cable, and a sleeve with a lip which fits over the small diameter coaxial cable. A tubular insulator fits inside the center portion of the body having a bore for a center contact. A thumbnut fits over the center area of the body and is held in place on the body by the large diameter of the body and by the lip of the sleeve. The sleeve is either screwed onto or crimped onto the small diameter of the body. The center conductor of the coaxial cable is crimped into the conical end protrusion of the center contact of the connector.

A significant aspect and feature of the present invention is a completely solderless coaxial connector which can be assembled in the field without any special tools and does not require any soldering to make an electrical connection.

An additional aspect and feature of the invention is a solderless coaxial cable connector which only requires an ordinary pair of pliers to assemble the connector after the coaxial cable has been prepared by stripping the outer insulating jacket, cutting a portion of the cable braid, and stripping the dielectric for insertion into the coaxial connector.

Having briefly described the embodiment of the present invention, it is a principal object thereof to provide a solderless coaxial cable male plug connector.

An object of the present invention is the provision of a solderless coaxial cable connector where the coaxial cable is held securely in place without indentation of the cable dielectric which assures no disturbance to the normal characteristic impedance of the cable.

Another object of the invention is the provision of a joint having strength afforded by the connector which is sufficient to withstand all the forces to which this type of connector might be subjected under normal conditions of use in the field.

A further object of the invention is the provision of a solderless coaxial cable connector which provides the user with a connector which is very easy to assemble, simple in construction, reasonable in cost to purchase and use, and efficient in carrying out the purpose for which it is designed. This connector has a minimum number of parts, allowing it to be assembled by any individual with only a pair of hand pliers.

Still another object of the invention is the provision of a solderless coaxial cable connector which only requires a pair of pliers and a knife to prepare the coaxial cable for insertion into the connector. The center contact is crimped onto the inner conductor of the coaxial cable and the outer conductor of the coaxial cable fits over the small diameter end of the body of the connector. Then, either a screw sleeve may screw on to the small end of the body which with the outer conductor of the coaxial cable sandwiched in between or a metal crimp sleeve can be crimped around the small end of the body with a crimping tool. The screw sleeve or the crimping sleeve permits a positive electrical connection between the outer conductor of the coaxial cable and the body of the coaxial connector.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
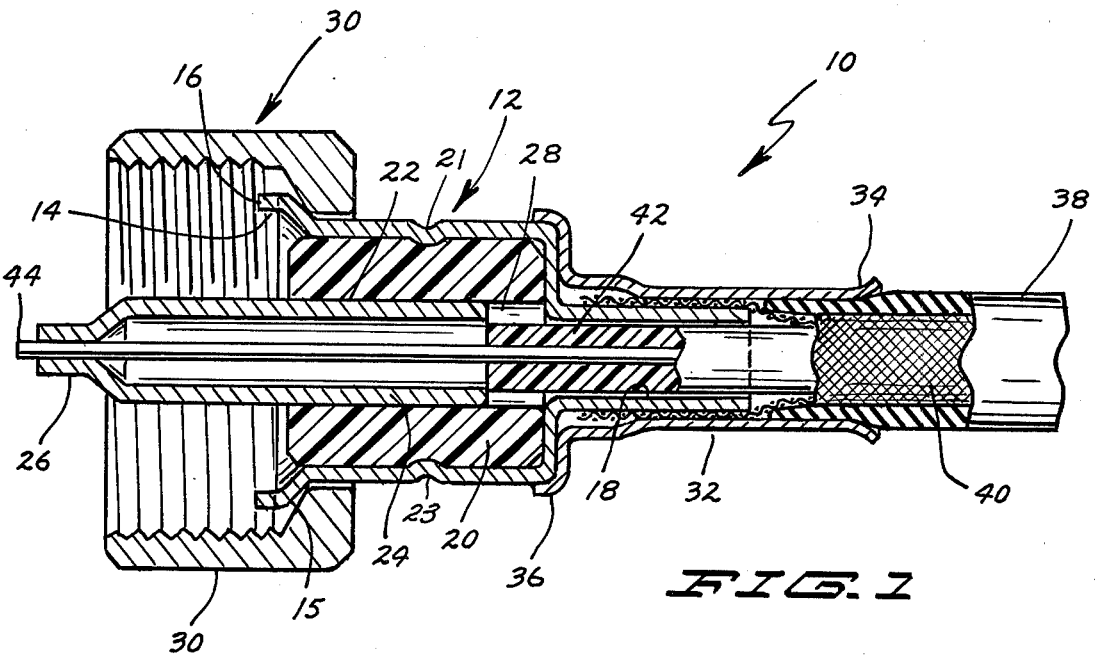
FIG. 1 illustrates a preferred embodiment of the crimp type solderless coaxial cable connector of the present invention.

FIG. 1 illustrates a preferred embodiment of a crimp type solderless coaxial cable connector 10 showing a conductive cylindrical body 12. The body 12, whose main conductive member is cylindrical in shape, has a large diameter 14 with four equally spaced diagonally opposite annular ratchet teeth 16 affixed to the end of the large diameter 14 to keep the connector from rotating. A small diameter 18 also connects to the body 12. The change in the diameter from the body 12 to the large diameter 14 is a gradual increasing flare 15 as illustrated in the drawing. A tubular insulator 20 fits into the central bore of the body 12 and is held in place by indentations 21 and 23. A central bore 22 is provided for a crimp type center contact 24. A conical end 26 is provided at the outer end of central contact 24. A space 28 is provided in insulator 20 to permit the insertion of the coaxial cable dielectric. A female thumbnut 30 is positioned at the central portion of the body between the front diameter section 14 and a sleeve 32. The sleeve 32 has a flared end 34 and a lip end 36 having a diameter slightly larger to overlap and encompass the end of the main conductive member portion of the body 12. A coaxial cable 38 is shown having an outer conductor 40 which fits between the small end 18 of the body 12 and the sleeve 32, a center dielectric 42 which abuts against the center contact 24 at space 28, and a center conductor 44, either solid or stranded which projects out of and is crimped at the conical end 26 of the center contact 24. The outer insulating jacket of the coaxial cable 38 abuts against the flared end 34 or into the flared end 34.

Figure 2:
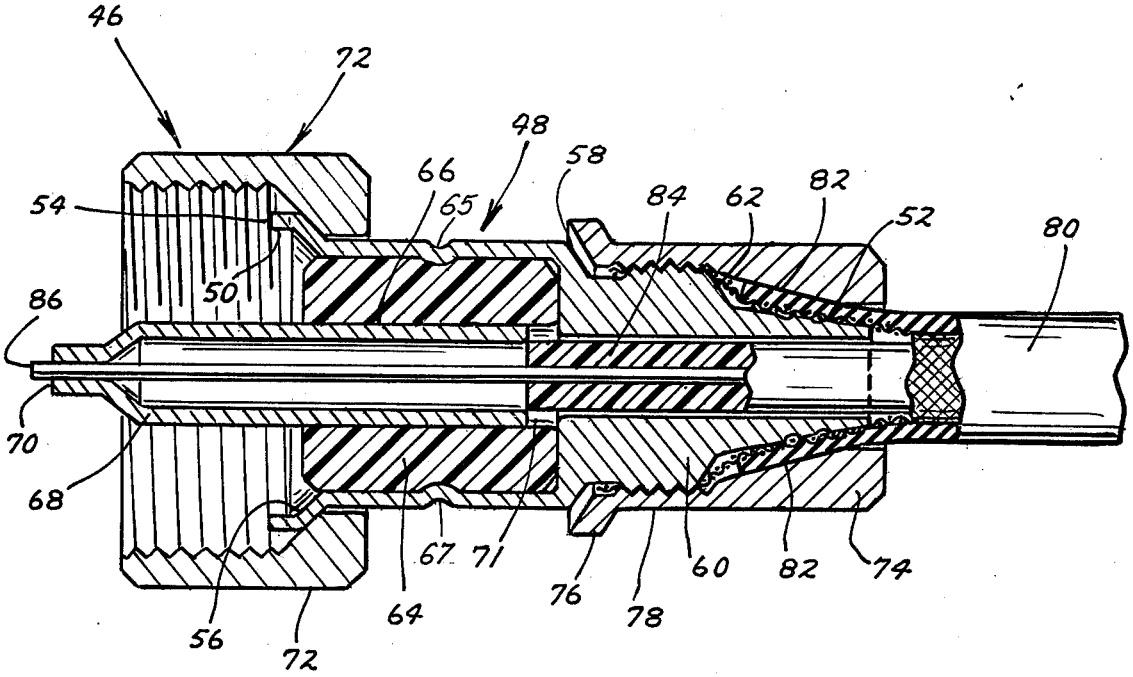
FIG. 2 illustrates a preferred embodiment of the screw-type solderless coaxial connector of the present invention.

FIG. 2 illustrates a preferred embodiment of a screw type solderless coaxial cable connector 46 having a body 48 whose main conductive member is cylindrical in shape with a large diameter 50 and a tapering small diameter 52. Four equally spaced diagonally spaced annular ratchet teeth 54 are affixed to the large diameter 50 to keep the connector from rotating when mated. The large diameter 50 connects to the body 48 with a tapering diameter 56. The small diameter 52 connects to the body 48 with a tapering diameter 58. Screw threads 60 are adjacent to tapering diameter 58 with subsequent tapering diameter 62 to reach the tapering small diameter 52. A tubular insulator 64 fits into the body 48 which has a center bore 66 and is held in place by indentations 65 and 67. A crimp type center contact 68 with a conical end 70 fits into the tubular insulator with a space 71 between the center contact 68 and the body 48. A female thumbnut 72 is held at the center portion of the body 48 between the front large diameter 56 and a large diameter 76 of a sleeve 74 which screws onto threads 60 of the body 48. The threads 78 of the sleeve 74 mate with the threads 60 to provide a positive electrical connection between the screw sleeve and the body 48 of which the outer conductor of the coaxial cable fits in between. The inner diameter of sleeve 74 is slightly larger than the outer diameter of the small diameter 52 of the body 48 to accomodate the outer insulating jacket of the coaxial cable. The outer insulating jacket of the coaxial cable 80 fits in the space between the small diameter 52 of the body 48 and the sleeve 74 with the outer braid conductor 82 of the coaxial cable being screwed between the threads 78 of the sleeve 74 and the threads 60 of the body 48. A center dielectric 84 abuts up against insulator 64 at the central bore of the body 48 up to the center contact 68 at space 70. The inner conductor of the coaxial cable 86 fits into the center contact 68 and is crimped at the conical end 70.

PREFERRED MODE OF OPERATION

The preferred mode of assembly of the solderless coaxial cable connectors 10 and 46 is now described in detail with reference being made to FIGS. 1 and 2.

In FIG. 1, the outer jacket of the coaxial cable 38 is stripped away for assembly into the solderless crimp type coaxial cable connector 10. That is, the outer jacket of the coaxial cable 38 is stripped away to expose the outer braid 40, which is trimmed back to an appropriate dimension to be accomodated by the small diameter 18 of the body 10 leaving the center dielectric 42 which is stripped away exposing a certain length of inner conductor 44 to be accomodated by the center contact 24 and the conical end 26. The thumbnut 30 is slid on to the body 12, the sleeve 32 is slid over the outer jacket of coaxial cable 38, and the coaxial cable 38 is inserted onto the small diameter 18 of the metal body 10 to sandwich the outer conductor braid 40 between the sleeve 32 and the small diameter 18 of the body 10 to provide an electrical connection for the cable braid 40 when crimped. The sleeve 32 may be crimped onto the body 12 with any well-known crimping tool in the art and the conical end 26 is crimped onto the inner conductor 44 of the coaxial cable 38. The large diameter 15 and 16 of the body 12 and the lip end 36 of the sleeve 32 maintains the thumbnut 30 on the central portion of the body 12.

The assembly of the coaxial cable into the solderless screw type coaxial cable connector 46 in FIG. 2 is similar to that of FIG. 1 except that the sleeve 74 is screwed onto and over the small end 52 of the body 48. The sleeve 74 is screwed with the outer braid conductor 82 sandwiched between the screw threads 60 and 78 permitting a positive electrical connection between the cable braid and the body 48. The thumbnut 72 is held onto the coaxial connector between the large diameter 56 of the body 48 and the large diameter 76 of the sleeve 74. The coaxial cable is likewise prepared to fit into connector by the common practice in the art.

Various modifications are contemplated and may obviously be resorted to by those skilled in the art without departing from the apparent scope of the invention as hereinafter defined by the appended claims and only a preferred embodiment thereof has been disclosed.

Having thus described the invention, there is claimed as new and desired to be secured by Letters Patent:

1. Solderless coaxial cable connector for terminating an end of a coaxial cable having an outer and inner conductor separated by a dielectric comprising:

a. a conductive cylindrical body having two ends, a gradual increasing flare connecting a large diameter means to one end of said body, a tapering diameter means connected to another end of said body, a threaded diameter means connected to said tapering diameter means, a second tapering diameter means connected to said threaded diameter means, and a small tapering diameter means connected to said second tapering diameter means, said small tapering diameter means having a more gradual taper than said second diameter means;

b. an integral tubular insulator securely held internal to said body by contact with indentation means in said body and having a central bore;

c. a center contact securely held internal to said central bore, protruding outwardly a distance beyond said large diameter means;

d. a conical end on said protruding end of said center contact;

e. a thumb nut means having a diameter to fit over said body; and, f. a sleeve means to thread onto said threaded diameter means of said body whereby said outer conductor of said coaxial cable is sandwiched between said threaded diameter means of said body and said sleeve means by said sleeve means when threaded onto said threaded diameter means, said dielectric is accommodated internally in said body between the distance of said tapering diameter means and said small tapering diameter means and in an internal space between another end of said center contact and an end of said tubular insulator, said inner conductor fits into said center contact and is crimped at said conical end of said center contact, and said thumb nut is retained on said body by said large diameter means of said body and said sleeve means.

* * * * *